US007022292B2

(12) United States Patent
Kawasaki et al.

(10) Patent No.: US 7,022,292 B2
(45) Date of Patent: Apr. 4, 2006

(54) RADIOACTIVE WASTE TREATMENT FACILITY

(75) Inventors: Tooru Kawasaki, Hitachi (JP); Atsushi Yukita, Hitachi (JP); Masato Ohura, Hitachi (JP); Yasuo Yatou, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 308 days.

(21) Appl. No.: 10/799,763

(22) Filed: Mar. 15, 2004

(65) Prior Publication Data

US 2005/0069467 A1 Mar. 31, 2005

Related U.S. Application Data

(63) Continuation of application No. 09/649,962, filed on Aug. 29, 2000, now Pat. No. 6,818,188.

(30) Foreign Application Priority Data

Dec. 15, 1999 (JP) ..... 11-356466

(51) Int. Cl.
*G21C 1/00* (2006.01)
*G21F 00/00* (2006.01)

(52) U.S. Cl. ..... 422/159; 422/903; 588/1; 588/2; 588/3; 588/4; 210/682; 210/691; 53/525

(58) Field of Classification Search ..... 422/159, 422/903; 588/1, 2, 3, 4; 210/682, 691; 53/525
See application file for complete search history.

(56) References Cited

U.S. PATENT DOCUMENTS 4,274,962 A 6/1981 Queiser et al.
4,629,587 A 12/1986 Monden et al.

FOREIGN PATENT DOCUMENTS

JP 8-29594 2/1996

*Primary Examiner*—Glenn Caldarola
*Assistant Examiner*—Alexis Wachtel
(74) *Attorney, Agent, or Firm*—Mattingly, Stanger, Malur & Brundidge, P.C.

(57) ABSTRACT

An injection and solidification operation as well as a kneading and solidification operation can be performed by a single facility. A decreased amount of radioactive secondary waste is generated. A solidifying agent paste is prepared by kneading a solidifying agent and additive water. The solidifying agent paste is injected into a solidifying container. The radioactive waste is charged into the solidifying container and kneaded.

6 Claims, 5 Drawing Sheets

(NON-RADIOACTIVE APPARATUS)

(RADIOACTIVE APPARATUS)

RADIOACTIVE WASTE TREATMENT FACILITY

This is a continuation application of U.S. Ser. No. 09/649,962, filed Aug. 29, 2000 now U.S. Pat. No. 6,818, 188.

BACKGROUND OF THE INVENTION

The present invention relates to a radioactive waste treatment facility for solidification of radioactive waste, which is generated from radioactive material handling facilities such as nuclear power plants, fuel reprocessing plants, and the like.

The radioactive waste generated from radioactive material handling facilities such as nuclear power plants, fuel reprocessing plants, and the like is generally solidified with a hydraulic solidifying material such as cement and the like. In accordance with the above processing, not only the volume of the radioactive waste can be reduced, but also stable a solidified waste superior in long term duration can be obtained.

Generally, the radioactive waste is classified to various groups having different properties each other such as miscellaneous solid waste, concentrated liquid waste, spent resin, ashes, and others. Respective of the groups is handled with an appropriate treating method of injecting solidification or kneading solidification depending on its kind and properties.

The injecting solidification is a method, in which the waste is contained in a drum first, and then, a solidifying agent is injected into the drum from the top of the drum for solidification. The injecting solidification method is applied to incombustible miscellaneous solid waste such as pipes and others, with which the solidifying agent can be flowed down through intervals among the solid waste.

The kneading solidification is a method, in which the waste is solidified by kneading with a solidifying agent. The kneading solidification method is applied to powder, granular, or liquid waste such as concentrated liquid waste and its dried powder, spent resin, ashes, and the like. At this time, there are in-drum type and out-drum type for the kneading method. The in-drum type method is a method, in which, after charging the waste and a solidifying agent together into a solidifying container (or during charging), a kneading blade is inserted into the charged materials to knead them. The out-drum type method is a method, in which, after charging the waste and a solidifying agent together into an exclusive kneading container and kneading the charged materials by inserting a kneading blade therein, the kneaded material is poured into a solidifying container.

As explained above, the injecting solidification and the kneading solidification are different solidification methods each other. Therefore, in order to treat miscellaneous many kind radioactive wastes adequately, an appropriate solidification facility must be provided respectively, and a significantly broad installation site area was required.

In order to solve the above problem, a radioactive waste treatment facility (solidification facility) comprising; a transferring means for transferring solidifying containers; an out-drum mixer type kneader which is capable of preparing kneaded material by charging a solidifying agent, additive water, and the radioactive waste together therein and kneading them; and a kneaded material injecting means, which injects the kneaded material into a solidifying container at a designated location in the transferring direction of the transferring means; is disclosed in JP-A-8-29594 (1996).

In accordance with the radioactive waste treatment facility, when performing the injection and solidification of the radioactive miscellaneous solid waste and others, a solidifying container wherein the radioactive waste is supplied previously is transferred to a designated location by the transferring means; only the solidifying agent and the additive water are charged into the kneader to prepare a solidifying agent paste; and the solidifying agent paste is injected into the solidifying container by the kneaded material injecting means. Accordingly, the solidifying agent paste is flowed down through the intervals among the solid waste to be filled into the solidifying container, and a solidified waste as same as the one obtained by a normal injecting solidification method can be prepared.

On the other hand, when concentrated liquid waste, spent resin, ashes, and the like are solidified by the kneading solidification, a solidified waste (homogeneous solidified waste), wherein the solidifying paste and the radioactive waste are mixed thoroughly, as same as the one obtained by a normal injecting solidification method can be prepare by the steps of: transferring an empty solidifying container to a designated location by the transferring means; charging a solidifying agent, additive water, and the radioactive waste into a kneading vessel of the kneader; agitating the charged material with kneading blade to form a kneaded material; and injecting the kneaded material into the solidifying container by the kneaded material injecting means.

In accordance with the prior art described above, kneading the solidifying paste (solidifying agent+additive water) for kneading solidification, and kneading the kneaded material for kneading solidification are performed by a similar out-drum-mixer type kneader, in order to make it possible to perform injecting solidification and kneading solidification together by a single facility.

However, in accordance with the above prior art, the following problems are still remained to be solved.

That is, the radioactive waste treating (solidification) facility must be cleaned up after completing a designated treatment. At that time, the portions touched with the radioactive water are contaminated with radioactive material, and washed water of the portions become secondary radioactive waste and another treating facility for the secondary radioactive waste becomes necessary. Accordingly, in the radioactive waste treating (solidification) facility, it is preferable that the portions touched with radioactive waste must be reduced as small as possible.

Generally, in case of out-drum type kneader is used in the kneading solidification, both the kneading blade and the kneading vessel are contaminated with radioactive material, and both of them must be washed. On the contrary, in case of in-drum type kneader is used, only the kneading blade is contaminated. Therefore, only the kneading blade must be washed, and the amount of secondary radioactive material can be reduced.

In accordance with the prior art, the out-drum mixer type kneader is used, in order to make it possible to perform injecting solidification and kneading solidification together by a single facility. Accordingly, both the kneading blade and the kneading vessel are contaminated with radioactive material in the kneading solidification operation, and both of them must be washed. Therefore, the amount of the secondary radioactive waste can be hardly reduced.

SUMMARY OF THE INVENTION

One of the objects of the present invention is to provide a radioactive waste treatment facility, which can perform both the injecting solidification and the kneading solidification together by a single facility, and makes it possible to reduce the generating amount of the secondary radioactive waste.

(1) In order to achieve the above object, the radioactive waste treatment facility of the present invention comprises;

a transferring means for transfer a solidifying container;

a solidifying agent kneading and injecting means for preparing a solidifying agent paste by kneading the solidifying agent and additive water, and injecting the solidifying agent paste into the solidifying container at a first location in the upstream of the transferring direction of the transferring means; and a waste charging and kneading means for charging the radioactive waste into the solidifying container at a second location in the downstream, in comparison with the first location, of the transferring direction of the transferring means, and kneading the radioactive waste with the solidifying paste in the solidifying container.

In accordance with the radioactive waste treatment facility of the present invention composed as described previously, when the injecting solidification of radioactive miscellaneous solid waste is performed, a solidifying container, wherein the radioactive waste is charged previously, is transferred to the first location by the transferring means, and the solidifying paste is injected into the solidifying container by the solidifying agent kneading and injecting means. Therefore, as the solidifying paste is filled into the solidifying container by flowed down through the intervals among the radioactive waste, a solidified waste as same as the one obtained by the normal injecting solidification can be prepared.

On the other hand, when the kneading solidification of radioactive concentrated liquid waste, spent resin, ashes, and others is performed, an empty solidifying container is transferred to the first location by the transferring means, and only the solidifying paste is injected into the solidifying container by the solidifying agent kneading and injecting means. Subsequently, the solidifying container is transferred to the second location; the radioactive waste is charged into the solidifying container, wherein the solidifying paste is filled previously, by the waste charging and kneading means at the second location; and kneading is performed in the solidifying container. Accordingly, a solidified waste (homogeneous solidified waste), the solidifying paste and the radioactive waste are mixed thoroughly, as same as the one obtained by the normal injecting solidification can be prepared.

In accordance with the composition described above, the injecting solidification and the kneading solidification can be performed by a single facility, and the solidifying agent kneading and injecting means can be made the out-drum type and the waste charging and kneading means can be made in-drum type.

At that time, the solidifying agent kneading and injecting means is used for kneading only the non-radioactive solidifying agent and the non-radioactive additive water. Therefore, the solidifying agent kneading and injecting means can be installed in an area separated by, for instance, a separation wall from the area where the waste charging and kneading means is installed. Because the liquid waste of washing is also non-radioactive, and it could be readily treated and deposited. On the other hand, the waste charging and kneading means is charged with radioactive waste when kneading and solidifying. Therefore, the liquid waste from washing the waste charging and kneading means becomes the secondary radioactive waste. However, the waste charging and kneading means can be made in-drum type, and washing is necessary only for kneading blade. Accordingly, the generating amount of the secondary radioactive waste can be reduced.

(2) In accordance with the above methods described in (1), the solidifying agent kneading and injecting means desirably comprises;

a kneading vessel, whereto the solidifying agent and the additive water is charged;

a first kneading blade for agitating inside of the kneading vessel;

an out-drum type kneader for preparing the solidifying agent paste; and an injecting means for injecting the solidifying agent paste in the kneader for preparing the solidifying agent paste into the solidifying container.

(3) In accordance with the above methods described in (1), the waste charging and kneading means desirably comprises;

an elevating means for elevating the solidifying container, which has been transferred to the second location by the transferring means, upward from the transferring line of the transferring means; and an in-drum type radioactive waste kneader, which charges the radioactive waste into the elevated solidifying container and performs kneading in the solidifying container with the second kneading blade.

(4) In accordance with the above methods described in (1), the solidifying agent injecting and kneading means is desirably provided in an area separated from the waste charging and kneading means by separating walls.

BRIEF DESCRIPTION OF THE DRAWINGS

These and other objects, features and advantages of the present invention will be understood more clearly from the following detailed description with reference to the accompanying drawings, wherein.

DETAILED DESCRIPTION OF THE PREFERRED EMBODIMENTS

Hereinafter, details of the embodiments of the present invention is explained referring to the FIGS. 1 to 5.

The solidification facility of the present embodiment is capable of solidifying four kinds of radioactive waste, i.e. the miscellaneous solid waste, spent resin, dried powder of concentrated liquid waste, and ashes, into a solidifying container (details will be explained later), into a solidifying container 4.

The solidification facility comprises;

a solidifying agent injecting and kneading mechanism 50 (details will be explained later) for injecting and solidifying the miscellaneous solid waste (hereinafter, called only as injecting solidification), and for injecting the solidifying agent paste at kneading and solidifying the spent resin, the dried powder of concentrated liquid waste, and the ashes (hereinafter, called only as kneading solidification);

a waste charging and kneading mechanism 60 (details will be explained later) for charging the radioactive waste and kneading at the kneading solidification;

and a transferring mechanism 5 (detail will be explained later) for transferring the solidifying container 4 (details will be explained later) selectively to the solidifying agent injecting and kneading mechanism or the waste charging and kneading mechanism depending on whether the operation is for the injecting solidification or the kneading solidification.

Figure 2A:
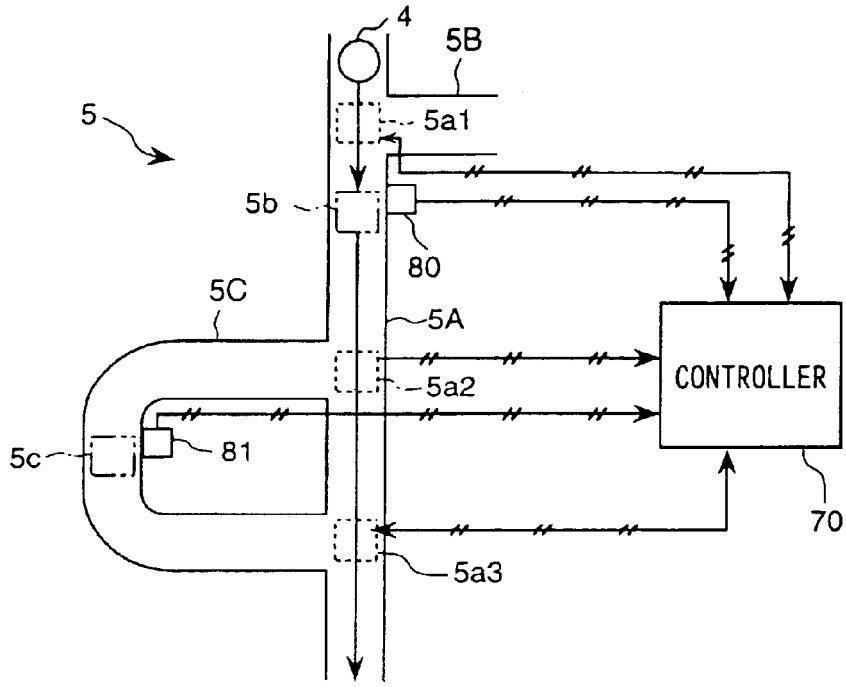
FIG. 2 is a set of schematic illustrations indicating the transferring route of the solidifying container in the transferring mechanism, which is provided in the radioactive waste solidification facility of the embodiment of the present invention.
Figure 2B:
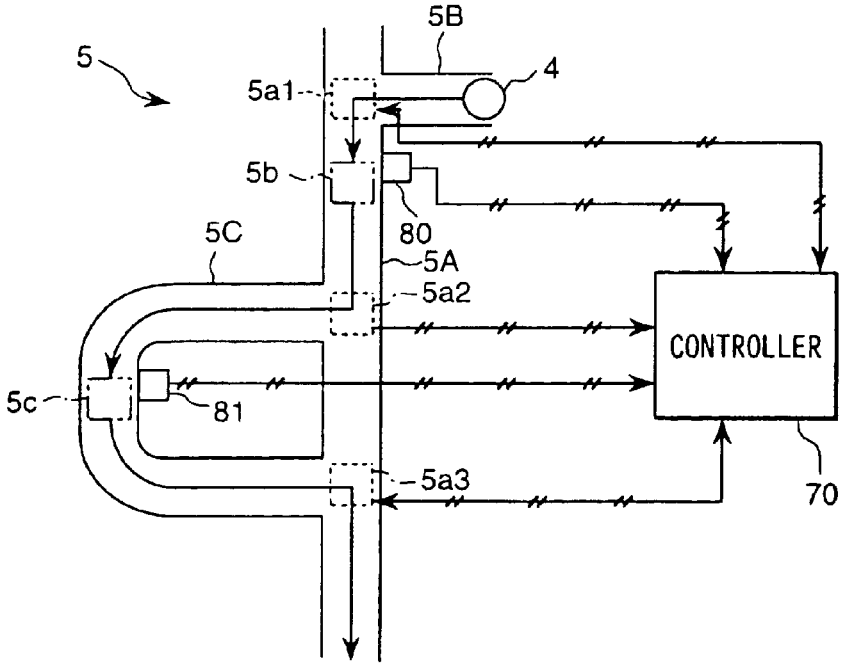
Figure 3A:
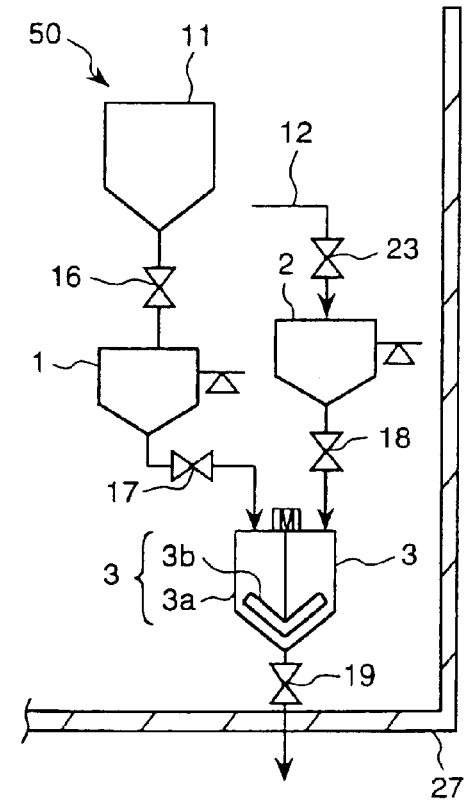
FIG. 3 is a schematic illustration indicating a total outline of the compositions of the solidifying agent injecting and kneading mechanism and the waste charging and kneading mechanism, which are provided in the radioactive waste solidification facility of the embodiment of the present invention.
Figure 3A:
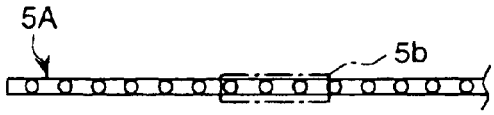
Figure 3B:
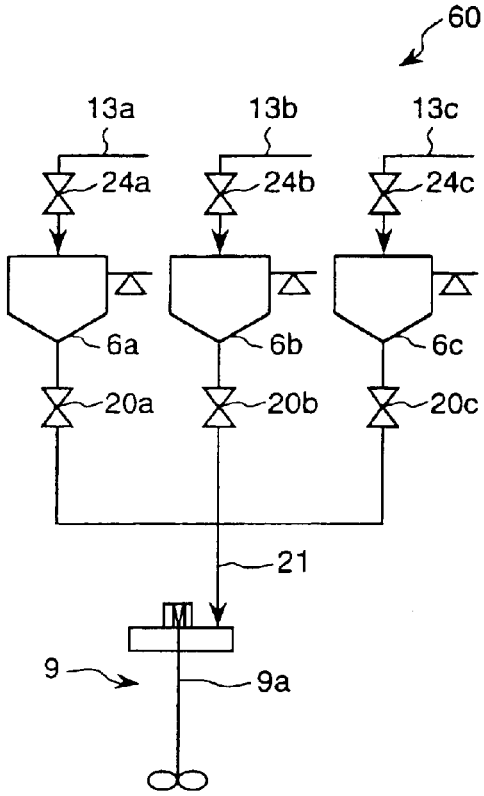
Figure 3B:
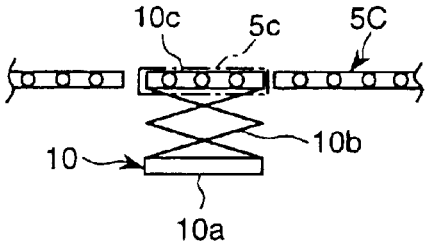

FIG. 2(*a*) and FIG. 2(*b*) are figures indicating the transferring route of the solidifying container 4 of the transferring mechanism 5 described above.

In accordance with FIG. 2(*a*) and FIG. 2(*b*), the transferring mechanism 5 is composed of, for instance, a plurality of rollers 50 arranged in a transferring direction (so-called roller conveyer, refer to FIG. 4); respective of the rollers is central-controlled by control signals (not shown in the figure) from the controller 70 installed in a control room (not shown in the figure) of the solidification facility.

The transferring mechanism 5 comprises; a main transferring route 5A; a sub-start up point route 5B, which merges with the main transferring route at a point of downstream side in the transferring direction near the start up point of the main transferring route 5A; and a sub-transferring route 5C, which branches at a point of downstream side from the merging point of the sub-start up point route 5B with the main transferring route 5A, and merges again with the main transferring route at a point of further downstream side from the branching point. Respective of the turn-tables $5a_1$–$5a_3$ is provided at the respective of the merging point of the main transferring route 5A with the sub-start up point route 5B, and the merging point and the branching point of the main transferring route 5A with the sub-transferring route 5C. The turn-tables are controlled automatically by the controller 70 (or manual control by inputting operation signals from the control panel to the controller 70 can be used) to switch the transferring route of the solidifying container 4 (detail will be explained later).

A sensor 80 (refer to FIG. 2) for detecting the solidifying container 4 when it is transferred is proved at the first position 5*b* on the main transferring route 5A (or a position before the first position 5*b* by a designated distance can be used). When detecting signals (refer to FIG. 2(*a*)) from the sensor 80 is transmitted to the controller 70, corresponding control signals (not shown in the figure) are output to the main transferring route 5A from the controller 70, and the solidifying container is stopped once at the first position 5*b*. The solidifying agent injecting and kneading mechanism 50 is provided at upper position of the first position 5*b*. A total outline of the compositions of the solidifying agent injecting and kneading mechanism 50 is indicated in FIG. 3(*a*).

In accordance with FIG. 3(*a*), the solidifying agent injecting and kneading mechanism 50 comprises;

a solidifying agent silo 11;

a solidifying agent weighing apparatus 1 for weighing the solidifying agent, which is supplied from the solidifying agent silo 11 via the solidifying agent supply valve 16;

an additive water supply line 12;

an additive water weighing apparatus 2 for weighing the additive water, which is supplied from the additive water supply line 12 via the additive water supply valve 23;

a kneader 3 for solidifying agent, which kneads the solidifying agent supplied from the solidifying agent weighing apparatus 1 through the solidifying agent supply valve 17 and the additive water supplied from the additive water weighing apparatus 2 via the additive water supply valve 18 to prepare the solidifying agent paste, and an injection valve 19 for injecting and filling the solidifying agent paste into the solidifying container 4.

The kneader 3 for solidifying agent is out-drum type apparatus comprising a kneading vessel 3*a*, whereto the solidifying agent and the additive water are supplied, and a kneading blade (agitating blade) 3*b* driven by a motor for agitating inside of the kneading vessel 3*a*.

Open-close operations of the waste supply valves 24*a*–24*c* and the waste supply valves 20*a*–20*c* are controlled by control signals from the controller 70 such as electric magnet valves, but details are omitted from the figures.

The whole solidifying agent injecting and kneading mechanism 50 composed as described above is installed in an area separated from the area where the other radioactive handling apparatus and facilities such as the waste charging and kneading mechanism 60 and others by, for instance, separating walls.

A sensor 81 (refer to FIG. 2) for detecting the solidifying container 4 when it is transferred there is provided at a second location 5*c* (at a position before a designated distance) in the sub-transferring route 5B (that is, at downstream side in the transferring direction from the first location) as indicated in FIG. 2(*a*) and FIG. 2(*b*). When the detecting signals of the sensor 81 (refer to FIG. 2) is transmitted to the controller 70, corresponding control signals are output from the controller 70 to the transferring mechanism sub-transferring route 5B, and the solidifying container 4 is stopped once at the second location 5*c*. The waste charging and kneading mechanism 60 is installed at the location upward the second location 5*c*. A whole schematic composition of the waste charging and kneading mechanism 60 is indicated in FIG. 3(*b*).

In accordance with FIG. 3(*b*), the waste charging and kneading mechanism 60 comprise;

waste supply lines 13*a*–13*c* for supplying radioactive waste, waste weighing apparatus 6*a*–6*c* for weighing the radioactive waste supplied from the waste supply lines 13*a*–13*c* via the waste supply valves 24*a*–24*c*, a waste supply line 21 for supplying the radioactive waste, which is weighed at respective of the waste weighing apparatus 6*a*–6*c*, via the waste supply valves 20*a*–20*c*, a solidifying container elevator 10 for elevating the solidifying container 4, which is transferred to the second location 5*c*, upwards from the transferring line 5C (refer to FIG. 1, explained later), and a kneader 9 for kneading waste, which charges the radioactive waste supplied from the waste supply line 21 into the elevated solidifying container 4, and kneads the radioactive waste in the solidifying container 4.

The kneader 9 for kneading waste is so-called in-drum type, which is provided with only kneading blade 9*a* (agitating blade) driven by motor for agitating inside of the solidifying container 4, and is composed so as to charge the radioactive waste supplied from the waste supply line 21 into the elevated solidifying container 4, and to knead the radioactive waste in the solidifying container 4 by dipping the kneading blade 9*a* therein (refer to FIG. 1, explained later).

The solidifying container elevator 10 comprises a base 10*a*; an extendable arm mechanism 10*b* provided with, for instance, a hydraulic cylinder; and a solidifying container platform 10*c* located at the second location 5*c* in the sub-transferring route 5C; and the solidifying container platform 10*c* can be elevated or lowered depending on extending-shrinking motion of the extendable arm mechanism 10*b* corresponding to extending-shrinking motion of the hydraulic cylinder.

The number of the waste supply lines 13*a*–13*c*, waste supply valves 24*a*–24*c*, waste weighing apparatus 6*a*–6*c*, and the waste supply valves 20*a*–20*c* to be provided are decided depending on the number of kinds of waste to be kneaded and solidified. For instance, spent resin is supplied through the waste supply line 13*a*, dried powder of concentrated liquid waste is supplied through the waste supply line 13*b*, and ashes is supplied through the waste supply line 13*c*.

The solidifying agent supply valve 16, the solidifying agent supply valve 17, the additive water supply valve 23, and the additive water supply valve 18 are controlled their open-close motion 8 for instance electric magnet valve) by the control signals from the controller 70, but details are omitted in the figure.

The whole waste charging and kneading mechanism 60 composed of the apparatus as explained above is installed in a radioactivity controlled area separated from the area where the other non-radioactive handling apparatus and facilities such as the solidifying agent injecting and kneading mechanism 50 and others by the separating walls 27 (refer to FIG. 3(*a*)).

Figure 4:
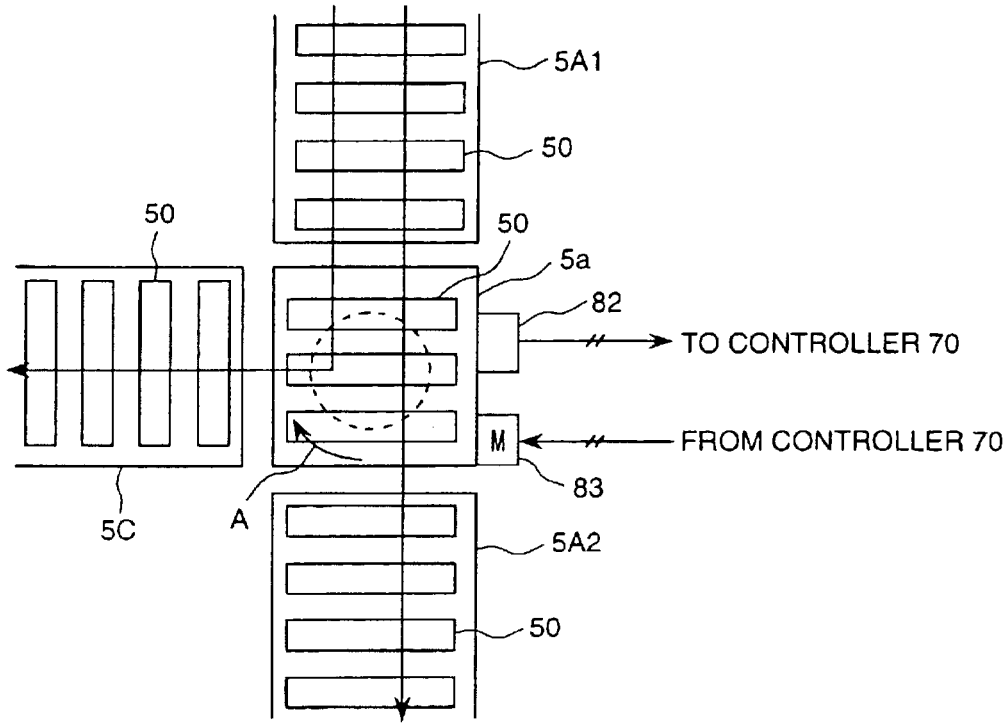
FIG. 4 is a schematic illustration indicating the composition of the turn-table indicated in FIG. 2(*a*) and FIG. 2(*b*)
Figure 5:
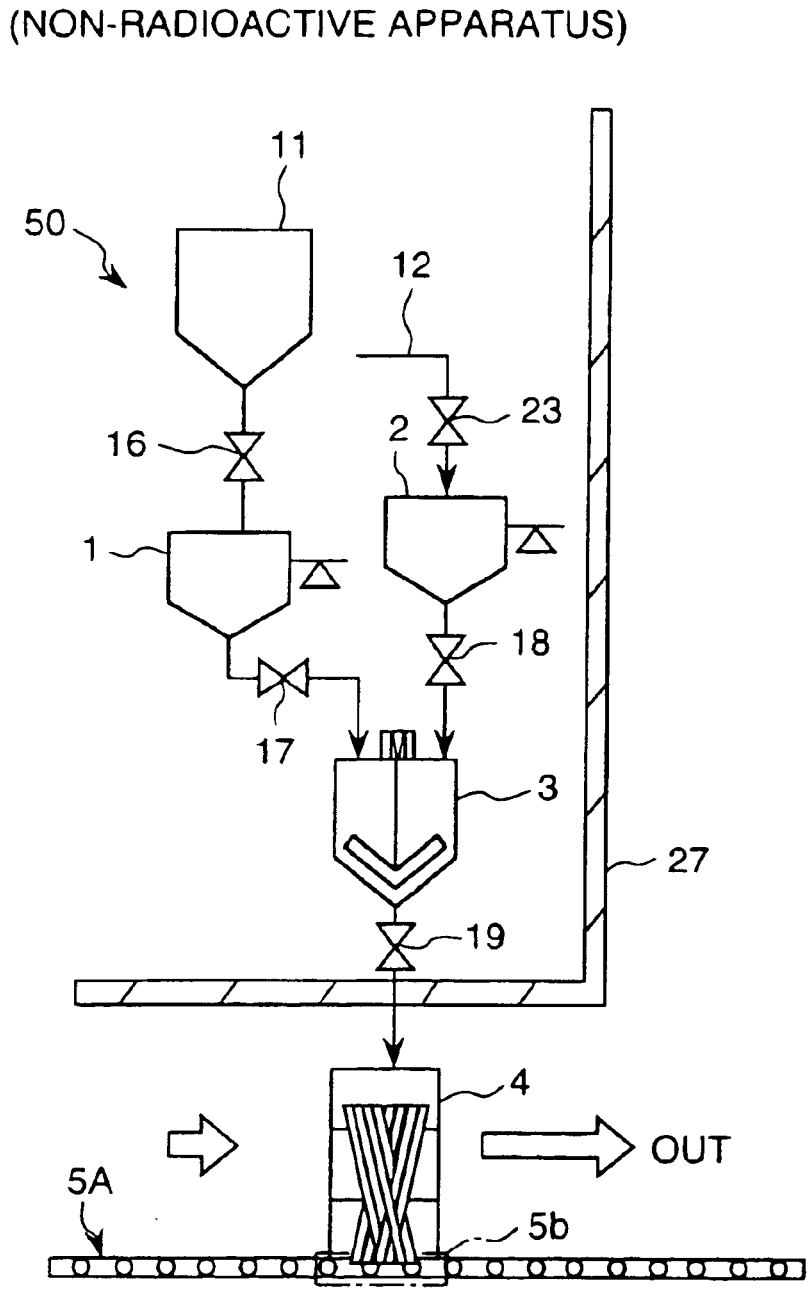
FIG. 5 is a flow diagram for indicating the behavior at the injecting and solidifying operation of the solidifying agent kneading and injecting means indicated in FIG. 3.

FIG. 4 is a schematic illustration indicating the composition of the turn-table 5*a*1 indicated in FIG. 2(*a*) and FIG. 2(*b*). The turn-table 5*a* is not operated for a special motion when the solidifying container 4 moves in a straight direction on the main transferring route 5A (that is, when it moves as route 5A1→turn-table 5*a*1→route 5A). However, when the moving direction must be changed (that is, when it moves as route 5A1→turn-table 5*a*1→route 5C), the turn-table is operated as follows.

That is, a sensor 82 for detecting the solidifying container 4 when it is transferred is provided at a designated position on the turn-table 5*a*1 (or a position at a designated distance before the designated position on the route 5A1 can be used). When a detecting signal of the sensor 82 is transmitted to the controller 70, a stop controlling signal (not shown in the figure) corresponding to the detecting signal is output from the controller 70 to the driving roller 50 on the turn-table 5*a*1, and the solidifying container 4 is stopped once on the turn-table 5*a*1.

Then, a control signal is output from the controller 70 to the driving device 83 for rotating the turn-table 5*a*1, and the turn-table 5*a*1 is rotated by 90 degrees in a direction indicated by an arrow A in FIG. 4.

After completing the rotation, a driving control signal (not shown in the figure) is output from the controller 70 to the driving roller 50 on the turn-table 5*a*1, and the transfer is resumed by transferring the solidifying container 4 to the sub-transferring route 5C from the turn-table 5*a*1.

Other two turn-tables 5*a*2, 5*a*3 are composed as same as above, but explanation is omitted.

As explained above, the transferring mechanism 5 composes the transferring means for transferring the solidifying container as claimed in respective of the claims.

A first kneading blade comprises the kneading blade 3*b* of the kneader 3 for solidifying agent, and the injecting means for injecting the solidifying agent paste in the kneader for solidifying agent comprises the injecting valve 19.

The solidifying agent injecting and kneading means for injecting the solidifying agent paste into the solidifying container at the first location in the upstream side in the transferring direction of the transferring means comprises; solidifying agent silo 11, solidifying agent supply valve 16, solidifying agent weighing apparatus 1, solidifying agent supply valve 17, additive water supply valve 23, additive water weighing apparatus 2, additive water supply valve 18, kneader 3 for solidifying agent, and injecting valve 19.

An elevating means for elevating the solidifying container, which is transferred to the second location by the transferring means, upwards from the transferring line of the transferring means comprises the solidifying container elevator 10, and the second kneading blade comprises the kneading blade 9*a* of the kneader 9 for waste.

The waste charging and kneading means, which is capable of charging radioactive waste into the solidifying container at the second location in the downstream of the first location in the transferring direction of the transferring means and of kneading the radioactive waste in the solidifying container, comprises waste supply lines 13*a*–13*c*, waste supply valves 24*a*–24*c*, waste weighing apparatus 6*a*–6*c*, waste supply valves 20*a*–20*c*, waste supply lines 21, and kneader 9 for waste.

The separating wall is composed of partition walls 27.

Operation of the radioactive solidification facility composed as explained above of the present embodiment is explained hereinafter.

In accordance with the solidification facility, an instruction for switching an injecting and solidifying mode for performing the injection and solidification, and a kneading and solidifying mode for performing kneading and solidification is input at the control room, and corresponding signal is output to the controller 70. Then, the controller 70 controls automatically respective of the apparatus so as to operate appropriately corresponding to respective of the wastes.

(1) Injection and Solidification

When the injecting and solidifying mode is selected in the control room, the solidifying container 4 is transferred by the route indicated in FIG. 2(*a*), and the solidification treatment is performed. The process is explained referring to FIG. 2(*a*) and FIG. 5.

In accordance with FIG. 2(*a*), the solidifying container 4, wherein miscellaneous solid waste has been charged by operators previously, is loaded on the main transferring route 5A, and transferred to the first location 5*b* by the transferring mechanism 5 and stopped once.

In a condition that the solidifying container 4 is stopped at the first location 5*b*, an adequate amount of solidifying agent for injection and solidification of the miscellaneous solid waste is weighed by the solidifying agent weighing apparatus 1, and injected into the kneader 3 for solidifying agent. Subsequently, an adequate amount of additive water for injection and solidification of the miscellaneous solid waste is weighed by the additive water weighing apparatus 2, and injected into the kneader 3 for solidifying agent. The solidifying agent and the additive water injected into the kneader 3 for solidifying agent is kneaded under a designated condition to be the solidifying agent paste, and injected into the solidifying container 4. The solidifying agent paste flows down through the intervals among the waste to fill the inside of the solidifying container 4. Accordingly, a solidified waste as same as the one obtained by the normal injection and solidification can be prepared.

The solidified waste of the miscellaneous solid waste obtained as above is transferred as it is on the main transferring route 5A by the transferring mechanism 5, and stored in a storage place (not shown in the figure).

(2) Kneading and Solidification

When the kneading and solidifying mode is selected in the control room, the solidifying container 4 is transferred by the route indicated in FIG. 2(*b*), and the solidification treatment is performed. The process is explained referring to FIG. 2(*b*) and FIG. 1.

In accordance with FIG. 2(*b*), the solidifying container 4 starts the sub-original point 5B as it is empty, which is different from the previous (1). The solidifying container 4 loaded on the sub-original point 5B is changed its transferring direction by the turn-table 5*a*1 to the main transferring route 5A, and transferred to the first location 5*b* by the transferring mechanism 5 and stopped once.

Figure 1:
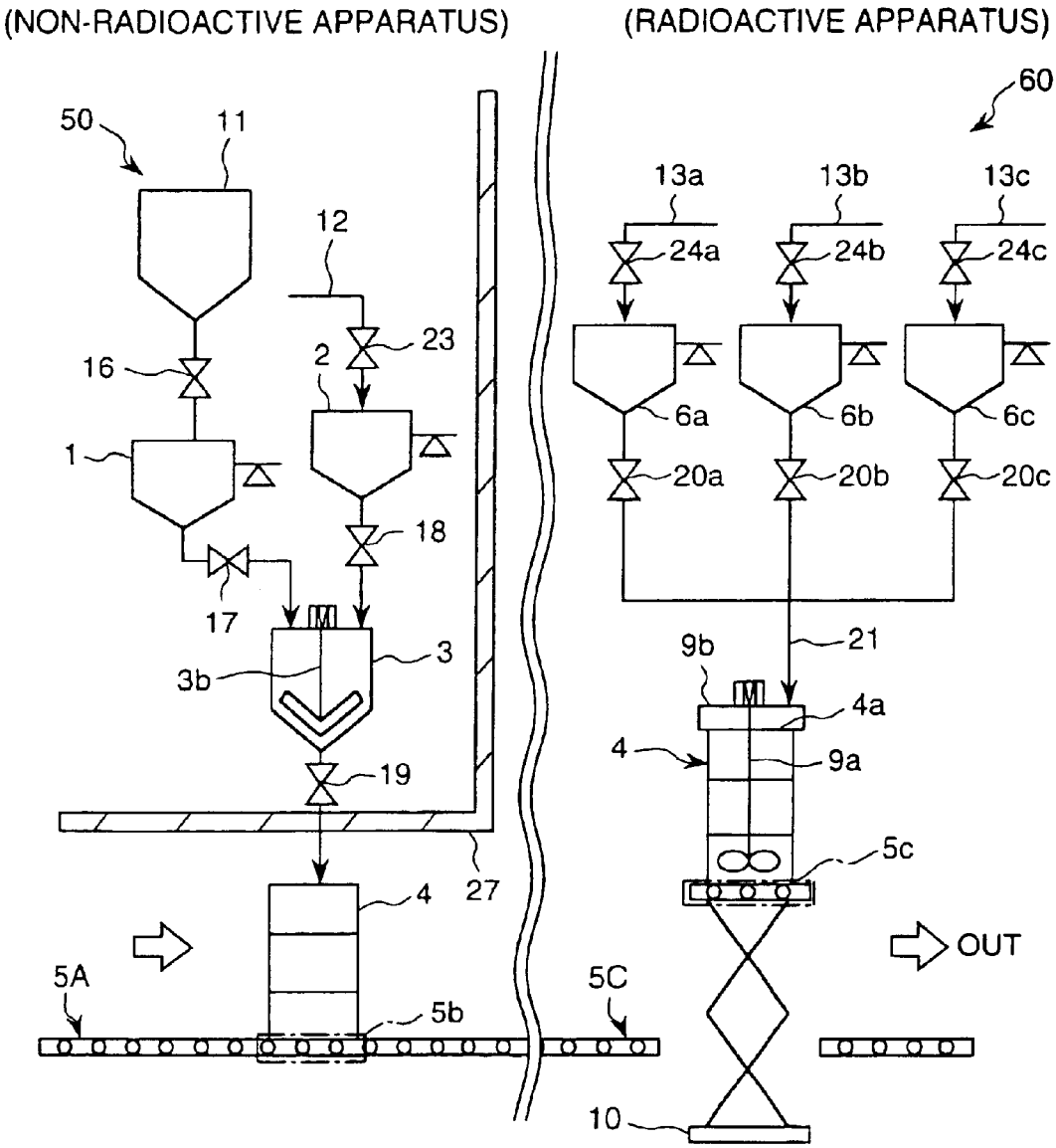
FIG. 1 is a flow diagram for explaining the behavior at the kneading and solidifying operation of the solidifying agent kneading and injecting means and the waste charging and kneading means, which are provided in the radioactive waste solidification facility of the embodiment of the present invention.

In a condition that the solidifying container 4 is stopped at the first location 5*b*, an adequate amount of solidifying agent for treating the waste (hereinafter, called selected waste) selected at the control room from spent resin, dried powder of concentrated liquid waste, and ashes is weighed by the solidifying agent weighing apparatus 1, and injected into the kneader 3 for solidifying agent, as indicated in FIG. 1. Subsequently, an adequate amount of additive water for solidification of the selected waste is weighed by the additive water weighing apparatus 2, and injected into the kneader 3 for solidifying agent. The solidifying agent and the additive water injected into the kneader 3 for solidifying agent is kneaded under a designated condition to be the solidifying agent paste having an adequate water-cement ratio and weight for kneading and solidification of the selected waste, and injected into the solidifying container 4.

The solidifying container 4 injected by the solidifying agent paste is transferred on the main transferring route 5A by the transferring mechanism 5, and changed its transferring direction by the turn-table 5*a*2 to the sub-transferring route 5C. The solidifying container 4 is transferred further to the second location 5*c* on the sub-transferring route 5C, and stopped there once.

Under the condition that the solidifying container 4 is stopped at the second location 5*c*, the solidifying container 4 is elevated by the solidifying container elevator 10, which is installed under the kneader 9 for waste, until the upper periphery 4*a* (an opening portion) of the solidifying container 4 is touched with the lid portion 9*b* of the kneader 9 for waste. In this condition, under agitation and kneading by driving the kneading blade 9*a*, a designated amount of selected waste is charged into the solidifying container 4 from the waste weighing apparatus 6*a*–6*c* corresponding to the selected waste.

Accordingly, a solidified waste, wherein the solidifying agent paste and the selected waste are mixed thoroughly, as same as the solidified waste (homogeneous solidified waste) obtained by the normal kneading and solidification can be prepared.

At this time, the kneading is continued for a designated time after completion of charging the total amount of the selected waste. After completion of the kneading, the solidifying container 4 is lowered to the level of the transferring mechanism 5 again by the solidifying container elevator 10. During the above operation, the upper periphery 4*a* of the solidifying container 4 and the lower plane of the lid portion 9*b* of the kneader for waste is contacted tightly in order to prevent the kneaded material in the solidifying container 4 from splashing out.

The homogeneous solidified waste obtained as described above is transferred on the sub-transferring route 5C again, changed its transferring direction by the turn-table 5*a*3 on the main transferring route 5A, and transferred on the main transferring route 5A to a storage place which is not shown in the figure.

In accordance with the solidifying facility of the present embodiment, which is composed as described above, the injection and solidification of miscellaneous solid waste and kneading and solidification of a several kinds of waste can be performed selectively by a single facility.

Furthermore, the solidifying agent injecting and kneading mechanism 50 can be made out-drum type, and the waste charging and kneading mechanism 60 can be made in-drum type.

In any cases of the above injection-solidification and kneading-solidification, the solidifying agent injecting and kneading mechanism 50 is used only for kneading the non-radioactive solidifying agent and the additive water. Therefore, the solidifying agent injecting and kneading mechanism 50 can be installed in an area separated by a partition wall 27 from the area where the waste charging and kneading mechanism 60, which is radioactive apparatus, is installed, and generated washing liquid waste can be treated and disposed readily because the liquid waste is non-radioactive. On the other hand, the waste charging and kneading mechanism 60 is radioactive because the radioactive waste is charged when kneading and solidifying, and the generated washing liquid waste becomes radioactive secondary waste. However, the waste charging and kneading mechanism 60, which is a radioactive apparatus, can be made in-drum type, and washing object is only the kneading blade 9*a*. Therefore, the generating amount of the radioactive secondary waste can be made small.

Generally, the solidifying agent paste prepared by kneading the solidifying agent and the additive water has a low viscosity, but the adding the waste and kneading increases the viscosity. In accordance with the out-drum type (kneading vessel+kneading blade) kneading and solidification, the increased viscosity of the kneading material generates a possibility to choke the outlet of the kneading vessel when the kneaded material is discharged.

In accordance with the present embodiment, an advantage is realized that the choke described above can be prevented, because kneading the solidifying agent paste having a low viscosity is performed by the out-drum type solidifying agent injecting and kneading mechanism 50, and kneading the radioactive waste is performed by the in-drum type waste charging and kneading mechanism 60.

In accordance with the present embodiment, changing the transferring direction of the solidifying container 4 is performed using the turn-table 5*a* by turning the turn-table 5*a* by 90 degrees under a condition that the solidifying container is loaded on the turn-table 5*a*, but methods of changing the transferring direction is not restricted to the above method, and other method is usable.

That is, when the solidifying container 4 is stopped on the turn-table 5*a*, for instance, the solidifying container 4 is transferred to the sub-transferring route 5C by hanging the solidifying container 4 with a hanger which is provided particularly, by pushing the solidifying container 4 to the direction toward the sub-transferring route 5C with a pusher which is provided particularly, or other transferring mechanism, which has a function to transfer the solidifying container 4 to the sub-transferring route 5C, inserted beneath driving rollers 50 of the turn-table 5*a* to operate between the rollers 50.

In accordance with the present invention, the injection and solidification operation and kneading and solidification operation can be performed selectively by a single facility, and generating amount of the radioactive secondary waste can be decreased.

What is claimed is:

1. A process of treating radioactive waste, comprising:

transferring a solidifying container to a first location of a radioactive waste treatment facility along a transferring line;

preparing a solidifying agent paste by kneading a solidifying agent and an additive water and injecting the solidifying agent paste into the solidifying container at the first location;

transferring the solidifying container to a second location downstream of the first location with respect to a process flow; and introducing radioactive waste into the solidifying container and kneading the radioactive waste and the solidifying agent paste in the solidifying container at the second location.

2. The process of treating radioactive waste, according to claim 1, further comprising the step of elevating the solidifying container from the transferring line.

3. The process of treating radioactive waste according to claim 1, wherein the kneading of the radioactive waste is performed by an in-drum type waste kneader.

4. The process of treating radioactive waste according to claim 2, wherein the kneading of the radioactive waste is performed by an in-drum type waste kneader.

5. The process of treating radioactive waste according to claim 1, therein the kneading to the radioactive waste is performed by kneading blades.

6. The process of treating radioactive waste according to claim 1, further comprising the step of providing a partition wall between said first location and said second location.

* * * * *